US005959254A

United States Patent [19]

Martin, Sr.

[11] Patent Number: 5,959,254

[45] Date of Patent: Sep. 28, 1999

[54] TAPERED SUPPORT INSULATOR FOR HEATING ELEMENTS HAVING CURVED SURFACE GROOVES FOR RETENTION OF THE HEATING ELEMENTS

[76] Inventor: Lendell Martin, Sr., 7037 Brittmore, Houston, Tex. 77041

[21] Appl. No.: 08/950,106

[22] Filed: Oct. 16, 1997

Related U.S. Application Data

[63] Continuation of application No. 08/726,768, Oct. 7, 1996, abandoned.

[51] Int. Cl.[6] ..... H01B 17/00

[52] U.S. Cl. ..... 174/138 J; D13/131; 219/536; 219/542; 219/546

[58] Field of Search ..... 174/138 G, 138 J, 174/154, 138 R, 160, 168; 392/425; 219/520, 532, 536, 542, 546; D13/131

[56] References Cited

U.S. PATENT DOCUMENTS

| | | | |
|---|---|---|---|
| D. 46,014 | 6/1914 | Austin | D13/131 |
| D. 52,139 | 4/1918 | Kendig | D13/131 |
| D. 258,877 | 4/1981 | King | D13/131 |
| D. 261,260 | 10/1981 | Seeley | D13/131 |
| D. 262,285 | 12/1981 | Janning | D13/131 |
| D. 285,919 | 9/1986 | Sherrill | D13/131 |
| 1,698,282 | 1/1929 | Simmons | 174/138 J |
| 3,009,044 | 11/1961 | Doehler | 338/234 |
| 4,268,742 | 5/1981 | Cottrell et al. | 219/532 |
| 4,363,959 | 12/1982 | Cottrell et al. | 219/532 |
| 4,458,141 | 7/1984 | Howard et al. | 219/532 |
| 4,472,624 | 9/1984 | Janning | 219/532 |
| 4,481,411 | 11/1984 | Roth | 219/532 |
| 4,531,017 | 7/1985 | Sherrill | 174/138 J |
| 4,559,412 | 12/1985 | Howard et al. | 174/138 J |
| 4,617,547 | 10/1986 | Howard et al. | 338/317 |
| 4,628,189 | 12/1986 | Danko | 219/532 |
| 4,628,190 | 12/1986 | Sherril | 219/532 |
| 4,675,511 | 6/1987 | Sherrill | 219/532 |
| 4,692,599 | 9/1987 | Howard et al. | 219/532 |
| 4,885,840 | 12/1989 | McManus | 29/611 |

OTHER PUBLICATIONS

"Design Features You Can Warm Up To," Tutco Applied Heating Technologies, 1994.

*Primary Examiner*—Hyung-Sub Sough
*Assistant Examiner*—Kamand Cuneo
*Attorney, Agent, or Firm*—Guy McClung

[57] ABSTRACT

An insulator has been invented for use between adjacent portions of wire coils of a helical heater wire, the insulator, in one aspect, having a body member with a front, a rear, a first side, a second side, a top, and a bottom, a first groove formed in the front of the body member and extending from the first side to the second side, the first groove for receiving and holding a first portion of a first wire coil. In certain aspects the insulator also has a second groove formed in the rear of the body member spaced apart from the opposite the first groove, the second groove extending from the first side to the second side, the second groove for receiving and holding a portion of a second wire coil adjacent to and spaced apart from the first wire coil. In one aspect the first and second grooves are at a top of the body member and another pair of such grooves are at the bottom of the body member. A heater element has been invented with such an insulator and a heater has been developed with such a heater element.

17 Claims, 4 Drawing Sheets

TAPERED SUPPORT INSULATOR FOR HEATING ELEMENTS HAVING CURVED SURFACE GROOVES FOR RETENTION OF THE HEATING ELEMENTS

This is a continuation of copending application Ser. No. 08/726,768 filed on Oct. 7, 1996 now abandoned.

BACKGROUND OF THE INVENTION

1. Field of the Invention

This invention is directed to insulators that retain and support electric heater coils, and to the insulators themselves.

2. Description of Related Art

Well known in the art are electric heaters that use resistance wire supported in or on a frame. Such heaters, typically called open-coil heaters, use insulators to separate the resistance wire from the frame structure and to avoid the possibility of a short circuit between the resistance wire and the frame. Such heaters use retainers to retain the wire in a predetermined configuration with respect to the frame.

Known prior art devices have attempted to provide insulators including coil holders for retaining a heater coil and insulating it from the heater framework. Wightman et al, U.S. Pat. No. 3,846,619, discloses insulators mounted on cross beams of a heater frame to support a helical heater wire. Clips attach to the insulators to support the heater coil. The clips are formed with flange surfaces bent in non-planar configurations to retain the heater wire. Insertion of part of the coil within the clip is difficult, as is removal of the coil, which might be required for maintenance or repair. The cross beams of the framework require a particular structure, and incorporate tabs to interact with portions of the insulator body to retain the insulator therein. Tabs are also required on the clips to secure them on the insulators.

Simmons, U.S. Pat. No. 1,698,282 shows an electric heater with insulators, or supports, which require special manipulation for mounting on the cross beams. Each support structure has two insulator elements. Simultaneous manipulation of the two elements is required in a 90° rotation for mounting and a complicated manipulation of several combined support structures is required for the removal of a single damaged support. Cotter pins are used to secure the supports in place. The supports cannot protrude through the cross beams, i.e. they support a heater coil on only one side of the frame.

A single integral insulator for an electrical heater which is mounted to a reflector in the heater is disclosed in Hartman, U.S. Pat. No. 2,856,500. The reflector has a plurality of key openings for receiving key-like projections from the insulator. The projections are narrower than the body of the insulator, and disposed on an opposite side of the body with respect to the heater coil support means. Tabs are used in the support beams for the insulators, and special rotational manipulation is needed for mounting the insulators on the heater reflector.

A variety of U.S. Patents disclose insulators that project through a radiation panel and disclose complex insulators which have complex openings; multiple notches with coil guide surfaces; and/or external notches for support rods that at least partially encircle the insulators; see, e.g. U.S. Pat. Nos. 4,458,141; 4,617,547; 4,363,959; 4,628,190; 4,559,412; 4,268,742; 4,675,511; 4,531,017; 4,692,599; 4,481,411; 4,472,624; 4,363,959; and U.S. Pat. No. Des. 285,919.

SUMMARY OF THE PRESENT INVENTION

The present invention, in certain embodiments, teaches a heater wire insulator support with a body with grooves in the ends thereof for receiving and holding a portion of a coil of the electrical resistance wire. In certain preferred embodiments the grooves are curved to correspond to a curved shape of the portion of the wire held therein. In certain aspects there is an opening through the body for a rod, beam, or other member that serves to support electrical resistance wire of a heater or which serves as a structural member for a heater housing or heater element panel. The opening can be only slightly larger than the cross-sectional area of the rod, etc. or it can be significantly larger to facilitate air flow around the portion of the rod, etc. extending through the support.

A heating element has one or more insulator supports as described herein, electrical resistance wire with portions held in the supports, a wall or panel on which the wire is mounted, and apparatus for mounting the wire to the wall or panel. In certain aspects a housing is used with the heating element.

The insulator support of the present invention may be sized so that the spacing between opposed portions of a wire coil which is mounted in a heater element is maintained when the portions are in the opposed grooves of the insulator support or so that said spacing is altered no more than about 30%, and preferably no more than 10%, without changing the general shape of the coils of wire, but with sufficient force of the wire exerted to maintain it within a groove or grooves of the insulator support. In embodiments with more than one groove, by placing the grooves for the wire on opposing sides of the insulator support, installation of wire coil portions in the grooves is facilitated, as well as wire coil removal therefrom. Simply snapping a wire portion into a groove secures it in place and pulling or pressing outward releases the wire. In certain preferred embodiments, there are no hooked parts on which wire can catch and no complex openings through which the wire must be moved to insert it or to free it. In other aspects certain prior art supports are improved by adding to them a groove or grooves according to the present invention, and/or by adding a tapered end according to the present invention and/or by adding a central opening open to one side of the supports.

In certain aspects, an insulator support according to the present invention has at least one wire groove which holds a portion of a single circular wire coil that is at least 10%, preferably 20%, and most preferably 25% or more of the entire circumference of one circular coil.

Certain embodiments of insulator supports according to the present invention have a body which, viewed from the front, does not have notches which project into the body and extend from the front side to a rear side, thereby weakening the body and forming projections and notches which make proper installation and removal difficult. Insulator supports according to the present invention which have a groove on a front or rear of a body, or grooves on the front and rear of a body, are easily moved between two adjacent wire coils since the distance between the front and the rear of the body approximates the distance separating the wire coils or is, preferably only slightly larger than that distance—as opposed to certain prior art supports with an end member of such size that the coils have to be pushed apart a relatively large distance to permit the end member to enter between the wire coils and to permit wire to enter notches on the end member or which require a central opening in addition to one or two side notches.

In certain aspects, insulator supports according to the present invention have two or more grooves at an end or at each end thereof for accommodating wire of different diameters. Thus a single insulator is useful with a variety of different wire coils and heater elements that use them.

In certain aspects the ends of an insulator according to the present invention are tapered (narrower at the ends of the body member) as viewed from the side to facilitate emplacement of the insulator between two wire coil portions and to reduce or eliminate undesirable deformation of the coil and unwanted expansion of the distance between said portions.

It is, therefore, an object of at least certain preferred embodiments of the present invention to provide:

The present invention discloses, in certain embodiments, an insulator for use between adjacent portions of a helical heater wire with multiple wire coils, the insulator having a body member with a front, a rear, a first side, a second side, a top end with a top, and a bottom end with a bottom, and a first groove formed in the front of the body member and extending from the first side to the second side, the first groove for receiving and holding a first portion of the a first wire coil of the helical heater wire; such an insulator with a second groove formed in the rear of the body member spaced apart from and opposite the first groove, the second groove extending from the first side to the second side, the second groove for receiving and holding a portion of a second wire coil of the helical heater wire adjacent to and spaced apart from the first wire coil; such an insulator wherein the first groove and second grooves are in the top end and the insulator has a third groove formed in the front of the body member in the bottom end thereof and extending from the first side to the second side, the third groove for receiving and holding a portion of a third wire coil of the helical heater wire, and a fourth groove formed in the rear of the body member in the bottom end thereof and spaced apart from and opposite the first groove, the fourth groove extending from the first side to the second side, the fourth groove for receiving and holding a portion of a fourth wire coil adjacent to and spaced apart from the third wire coil; such an insulator wherein the first groove has a shape corresponding to a shape of the first portion of the first wire coil; such an insulator wherein each groove has a shape corresponding to a shape of a portion of a wire coil received and held therein; such an insulator wherein the first side and the second side taper toward each other and toward the top of the body member; such an insulator wherein the first side and the second side also taper toward each other at the bottom of the body member; such an insulator wherein the front and the rear of the body member taper toward each other at the top of the body member; such an insulator wherein the front and the rear of the body member taper toward each other at the bottom of the body member; such an insulator wherein the helical heater wire is a first helical heater wire and the first helical heater wire has an outer diameter and each of the first, second, third, and fourth grooves are sized to accomodate the first helical heater wire and the insulator has at least one or more additional grooves in the body member for receiving and holding a portion of a coil of a second helical heater wire disposed adjacent the first helical heater wire, the second helical heater wire having an outer diameter different from that of the first helical heater wire; such an insulator wherein the at least one additional grooves is one or more pairs of spaced apart grooves, each pair having one groove on the front and one groove on the rear of the body member; such an insulator wherein the first groove holds no more than about 15%, 20%, or 25% of the circumference of the first wire coil; such an insulator wherein the first groove holds at least 10%, 20% or 25% of the circumference of the first wire coil such an insulator with an opening through the body member for receiving a support member, the opening either surrounded by the body member or having a protion open to the exterior of the body member; such an insulator wherein the front and the rear of the body member have a first width and the first side and the second side have a second width, and the first width is greater than the second width; such an insulator wherein the first width is equal to the second width or the first width is at least one-and-a-half times or twice the second width; such an insulator wherein multiple wire coils of the helical heater wire are spaced apart by a first distance and the second width is no more than one hundred and five percent, one hundred and ten percent, or one hundred and fifteen percent of the first distance; such an insulator including the helical heater wire and a support panel, the insulator mounted to the support panel and disposed with the first portion of the first wire coil in the first groove, the insulator supporting the helical wire spaced apart from the panel.

New, useful, unique, efficient, nonobvious insulator supports for supporting coils of wire useful therewith;

Such insulator supports which are easily installed between wire coils;

Such insulator supports without notches extending all the way through a body member thereof from front to rear;

Such insulator supports with one or more grooves for receiving wire, each groove corresponding in shape to a portion of a coil of the wire;

Such insulator supports with a plurality of such grooves for accommodating wire of different diameters with a single support.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
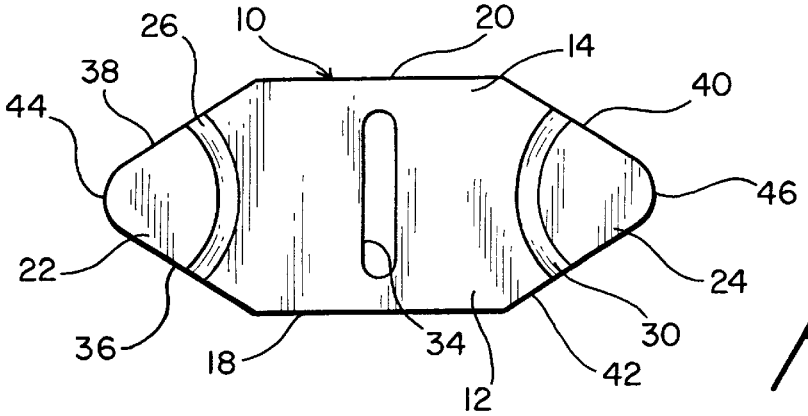
FIG. 1A is a front view of an insulator according to the present invention.
Figure 1B:
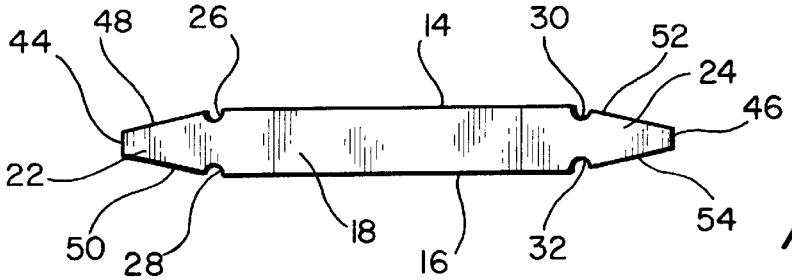
FIG. 1B is a side view of the insulator of FIG. 1A.
Figure 1C:
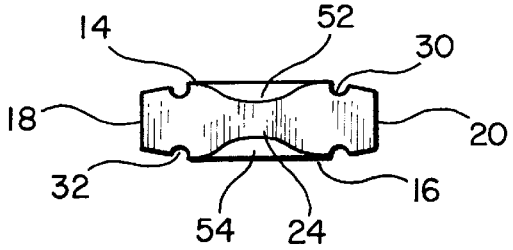
FIG. 1C is an end view of the insulator of FIG. 1A.

Referring now to FIG. 1, an insulator support 10 according to the present invention has a body 12, a front face 14, a rear face 16, a side 18, and a side 20, a top end 22, and a bottom end 24. Wire grooves 26 and 28 extend across the end 22 on opposite sides of the body 12. Wire grooves 30 and 32 extend across the end 24 on opposite sides of the body 12.

As viewed in FIG. 1*a*, the shapes of the grooves 26 and 30 (and of the grooves 38 and 32) are configured to correspond to the shape of a circular or curved portion of a coil part of a helical heater resistance wire. Additionally, the width of the grooves 26 and 30 (and of the grooves 28 and 32) is such that the wire is easily placed into the grooves with a snap fit and easily pulled or pressed out of the grooves. The distance between the two grooves is chosen so that wire of two adjacent coil portion in a heater may be supported by one insulator support 10. A central opening 34 receives a beam, rod or other structural support secured itself to a panel or housing and extending through the insulator support 10.

Although it is within the scope of this invention for the insulator support 10, as viewed in FIG. 1*a*, to be any suitable shape (e.g. but not limited to, oval, rectangular, rectangular with rounded corners, circular, triangular, or triangular with rounded corners) as shown in FIG. 1*a* the insulator support 10 has ends 22 and 24 with sides 36, 38 and 40, 42 respectively which taper to a blunt rounded extremity 44, 46 respectively to facilitate insertion between adjacent coils of a heater wire. Also, as shown in FIG. 1*b*, sides 48, 50 and 52, 54 of the ends 22 and 24, respectively, taper from the body 12 to the blunt rounded extremities 44, 46 respectively.

The length of the sides 18 and 20 is chosen to facilitate emplacement of the insulator support 10 between two adjacent coils of a heater wire.

The insulator support 60 according to the present invention with a body 62 is like the insulator support 10, but it has multiple sets of grooves at each end for accommodating a variety of different diameter heater resistance wires; it has a rectangular shape with round corners; and it has a central opening with an end open to the exterior of the insulator support. Grooves 72, 74, 76, and 78 are of one width and depth for accommodating a first size wire and grooves 82, 84, 86 and 88 have a larger width and depth for accommodating a wire with a larger diameter. A central opening 70 for a beam, rod, etc., has an open end 80 to facilitate emplacement of the insulator support on a beam, rod, etc., or to facilitate emplacement of the beam, rod, etc. in the opening 70. It is within the scope of this invention to provide two, three, four or more sets of grooves so that a single insulator support is useful with two, three, four or more different wires of different diameters.

Figure 3A:
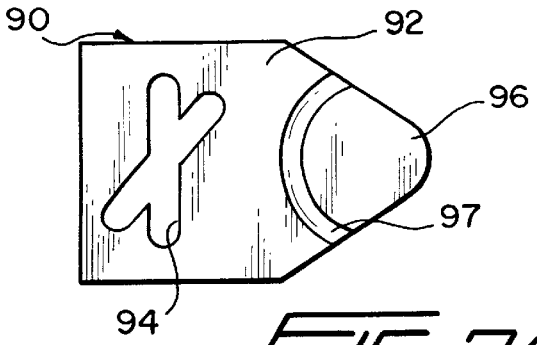
FIG. 3A is a front view of an insulator according to the present invention.
Figure 3B:
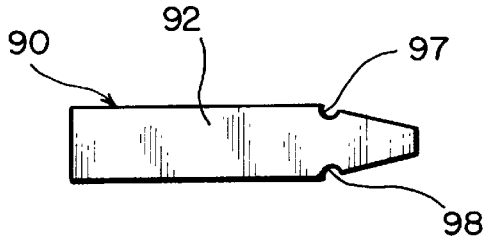
FIG. 3B is a side view of the insulator of FIG. 3A.

FIGS. 3*a* and 3*b* show an insulator 90 according to the present invention with a body 92, an opening 94 therethrough, an optional tapered end 96 and wire grooves 97 and 98 on opposite side of the body 92 (either or both tapers may be deleted, i.e., the taper as viewed in FIG. 3*a* or in FIG. 3*b*). One or the grooves 97 or 98 may be deleted and the body 92 may be sized so that the force of a multi-coil wire holds a portion of a coil in a single groove in the body 92. The body 92 may have a set of various single grooves of different size all on one side (e.g. top or bottom as viewed in FIG. 3*b*) of the body 92.

Figure 4A:
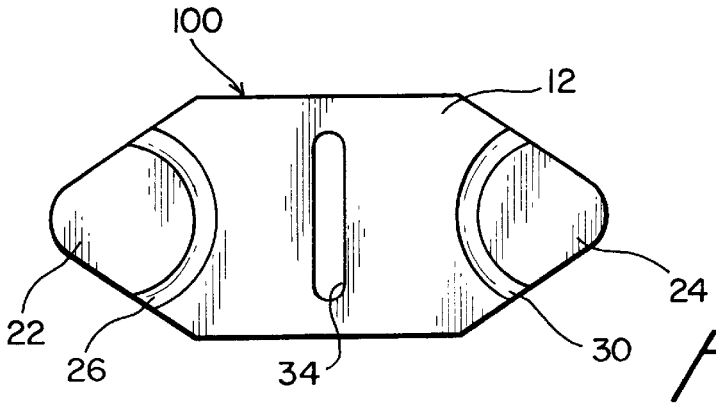
FIG. 4A is a front view of an insulator according to the present invention.
Figure 4B:
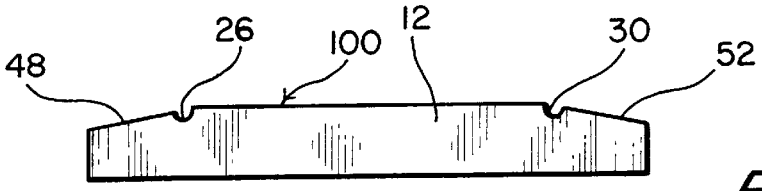
FIG. 4B is a side view of the insulator of FIG. 4A.

FIGS. 4*a* and 4*b* show an insulator support 100 like the insulator support 10 and like numerals indicate similar parts and structure. The grooves 28 and 32 are not present in the insulator support 100 and the spring force of a helical wire with multiple coils is used to maintain wire coil portions in the grooves 26 and 30. Also deleted are tapered sides 50 and 54.

Figure 5:
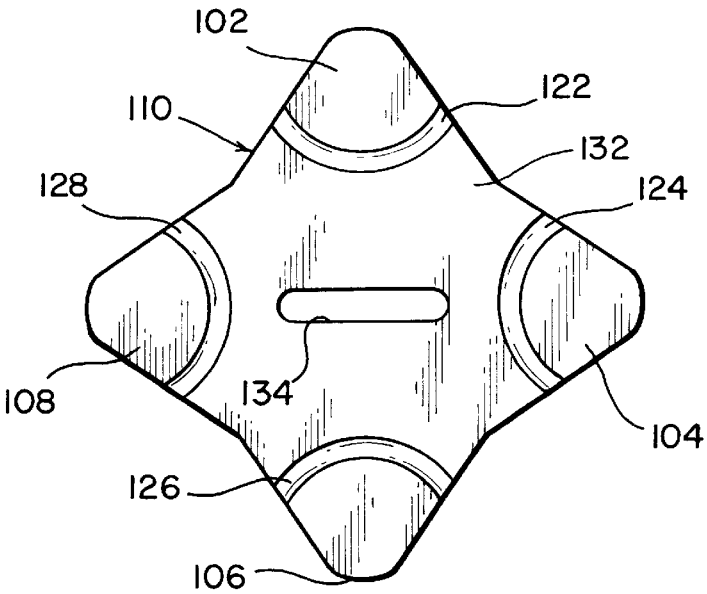
FIG. 5 is a front view of an insulator according to the present invention.

FIG. 5 shows an insulator support 110 according to the present invention which is like the insulator support 10 but which has four tapered ends 102, 104, 106, and 108 on its body 132 (as compared to the two tapered ends 22 and 24 of the body 12). Each tapered end has a respective wire groove, 122, 124, 126, and 128. Although as shown the insulator support 110 has wire grooves only on the face shown. It is within the scope of this invention for the body 132 to have one, two, three, four or more additional grooves on the face of the body 132 opposite the face shown in FIG. 5 (e.g. opposed grooves as the grooves 26 and 28 of the insulator support 10). The insulator support 10 can accommodate two, three or four helical resistance wires simultaneously. A central opening 134 for a beam, rod, etc. extends through the body 132.

Figure 6A:
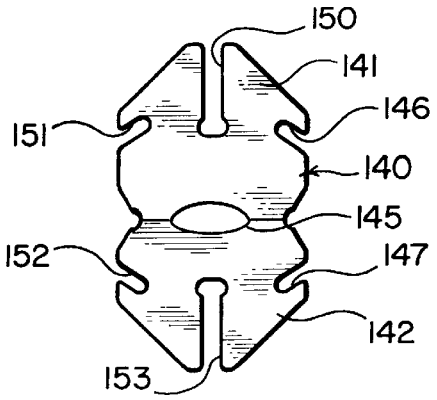
FIG. 6A is a front view of an insulator according to the present invention.
Figure 6B:
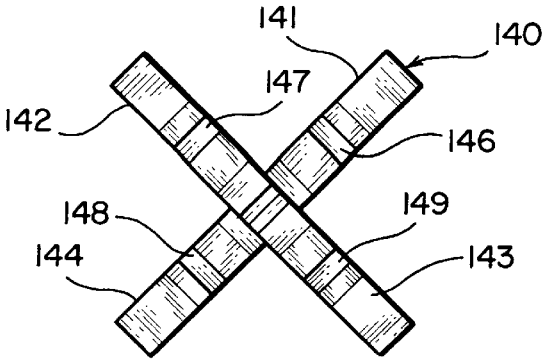
FIG. 6B is a top view of the insulator of FIG. 6A.

FIGS. 6*a* and 6*b* show an insulator support 140 according to the present invention with a series of support ends 141, 142, 143, 144 and a central hole 145 therethrough. Each support end has two side notches (e.g. 146, 151 for the end 141; 147, 152 for the end 142; notch 148 and another notch, not shown, for the end 144; and notch 149 and another notch, not shown, for the end 143). Each end also has a central notch (e.g. as notches 150 or 153). The insulator support 140 can accommodate two, three or four coils of adjacent helical multi-coil resistance wire. Part of the end structure shown is disclosed in U.S. Pat. No. Des. 285,919 (incorporated fully herein by reference), but the patent has no teaching or suggestion of the multiple end-member insulator support 140.

Figure 2A:
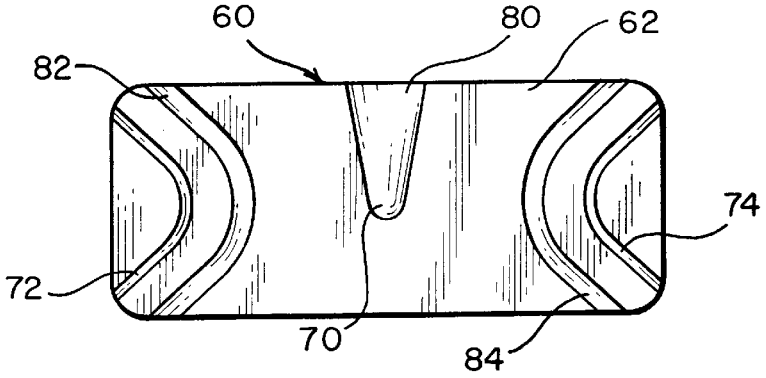
FIG. 2A is a front view of an insulator according to the present invention.
Figure 2B:
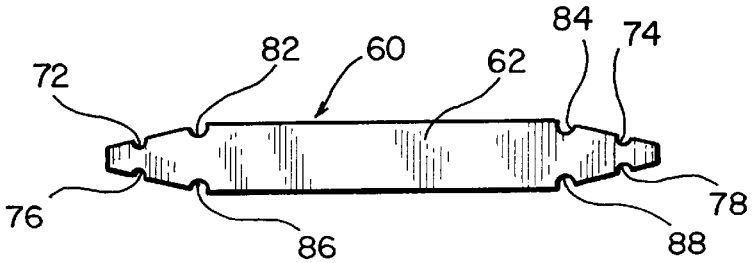
FIG. 2B is a side view of the insulator of FIG. 2A.
Figure 7:
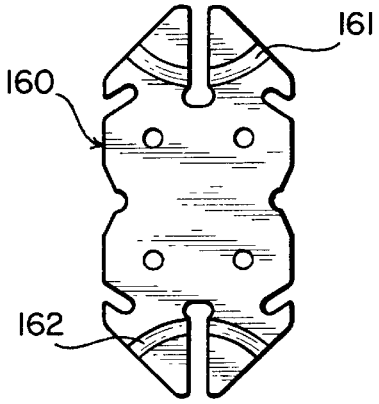
FIG. 7 is a front view of an insulator according to the present invention.

FIG. 7 shows an insulator support 160 according to the present invention which is like the device of U.S. Pat. No. 4,675,511 (incorporated fully herein by reference), but the device 160 has one or more (two shown) wire grooves 161 and 162 like the grooves 26 and 30 of the insulator support 10. U.S. Pat. No. 4,675,511 has no teaching or suggestion of such grooves. Additional grooves (e.g. as in FIG. 1*a* or FIG. 2*a*) may be used with the insulator support 160.

Figure 8:
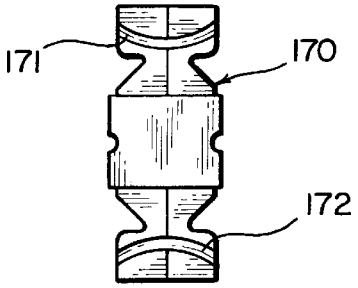
FIG. 8 is a front view of an insulator according to the present invention.

FIG. 8 shows an insulator support 170 according to the present invention which is like the device of U.S. Pat. No. 458,141 and 4,559,412 (incorporated fully herein by reference), but the device 170 has one or more (two shown) wire grooves 171 and 172 like the grooves 26 and 30 of the insulator support 10. U.S. Pat. Nos. 4,458,141 and 4,559,412 have no teaching or suggestion of such grooves. Additional grooves (e.g. as in FIG. 1*a* or FIG. 2*a*) may be used with the insulator support 170.

Figure 9B:
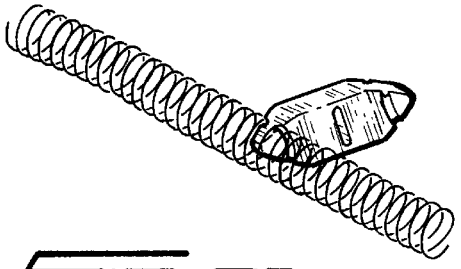
FIG. 9B shows the insulator installed in the wire coil.
Figure 9A:
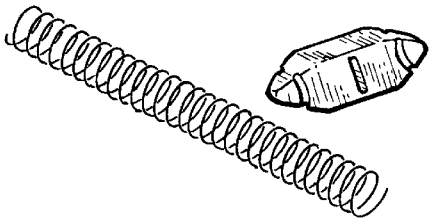
FIG. 9A is a perspective view of a wire coil portion and of an insulator according to the present invention.

FIG. 9*a* shows an insulator support 10 and a section of a helical multi-coil heater resistance wire H. FIG. 9*b* shows the insulator support 10 in place between two adjacent coils A and B of the wire H.

Figure 10:
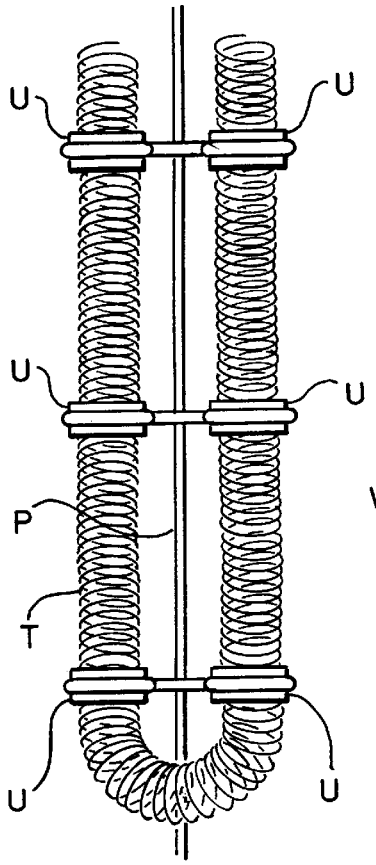
FIG. 10 (PRIOR ART)
FIGS. 10 and 11 are top view of prior art heater elements with prior art insulators.
Figure 11:
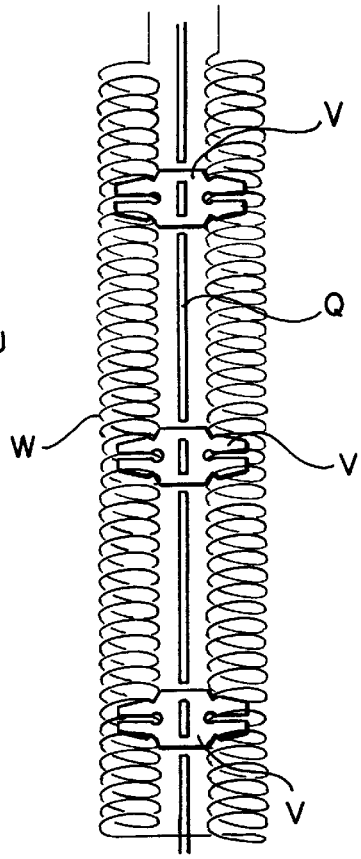
FIG. 11 (PRIOR ART)
Figure 12:
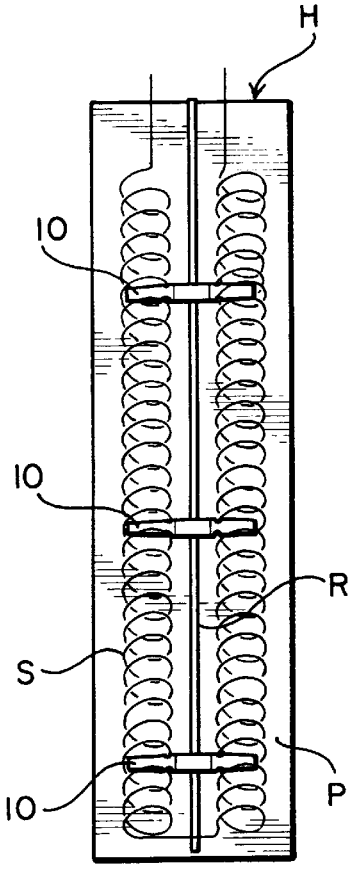
FIG. 12 is a top view of a heater, heater element, and insulators according to the present invention.

FIGS. 10 and 11 show prior art heater wires T and W, respectively, supported by insulator supports U and V respectively and support rods P and Q respectively. FIG. 12 shows heater coiled wire S supported by insulator supports 10 according to the present invention with a rod R therethrough which is secured to a panel P of a heater H.

Figure 13:
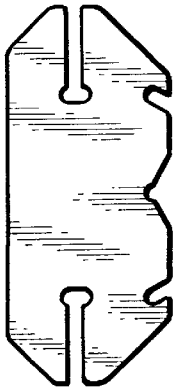
FIG. 13 is a front view of an insulator design according to the present invention.
Figure 14:
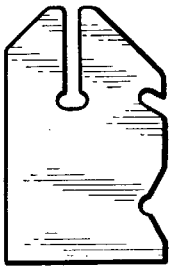
FIG. 14 is a front view of an insulator design according to the present invention.

FIGS. 13 and 14 show new nonobvious versions of insulator support designs like (but patentably different from) those of U.S. Design Patent No. Des. 285,919.

Any insulator support according to the present invention may be made of any suitable insulating material, including, but not limited to, ceramic, asbestos, fiberglass, cement, glass, or some combination thereof.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. An insulator for use between adjacent portions of a helical heater wire with multiple wire coils, the insulator comprising a body member with a front, a rear, a first side, a second side, a top end, and a bottom end wherein the front and rear define front and rear surface areas, and the first side and second side define first and second surface areas, the front and rear surface areas being substantially larger than the first and second surface areas, causing the body member to be generally planar, and a first groove formed in the front of the body member and extending from the first side to the second side, the first groove for receiving and holding a first portion of a first wire coil of the helical heater wire, the first groove having a curved shape corresponding to a curved shape of the first portion of the first wire coil, a second groove formed in the rear of the body member spaced apart from and opposite the first groove, the second groove extending from the first side to the second side, the second groove for receiving and holding a portion of a second wire coil of the helical heater wire adjacent to and spaced apart from the first wire coil, a third groove formed in the front of the body member in the bottom end thereof and extending from the first side to the second side, the third groove for receiving and holding a portion of a third wire coil of the helical heater wire, and a fourth groove formed in the rear of the body member in the bottom end thereof and spaced apart from and opposite In the third groove, the fourth groove extending from the first side to the second side, the fourth groove for receiving and holding a portion of a fourth wire coil adjacent to and spaced apart from the third wire coil, the first side and the second side tapering toward each other, at the top of the body member, the front and the rear of the body member tapering toward each other at the top of the body member.

2. The insulator of claim 1 wherein each of said first, second, third and fourth grooves has a shape corresponding to a shape of a portion of said first, second, third and fourth wire coils, respectively.

3. The insulator of claim 1 wherein the first side and the second side also taper toward each other at the bottom of the body member.

4. The insulator in claim 1 at least one additional groove in the body member for receiving and holding a portion of a coil of a second helical heater wire, having a diameter different from said helical heater wire, disposed adjacent said helical heater wire.

5. The insulator of claim 4 wherein the at least one additional groove is a pair of spaced apart grooves, one groove from said pair on the front and another groove from said pair on the rear of the body member.

6. The insulator of claim 1 wherein the first groove is for holding no more than about 20% of the circumference of the first wire coil.

7. The insulator of claim 1 wherein the first groove is for holding at least 10% of the circumference of the first wire coil.

8. The insulator of claim 1 further comprising an opening through the body member for receiving a support member.

9. The insulator of claim 1 wherein the maximum width from the front to the rear across either of said first or second sides is dimensioned for being no more than 110% of the separation of coils of said multiple wire coils.

10. An insulator for use between adjacent portions of a helical heater wire with multiple wire coils, the insulator comprising a body member with a front, a rear, a first side, a second side, a top end and a bottom end wherein the front and rear define front and rear surface areas, and the first side and second side define first and second surface areas, the front and rear surface areas being substantially larger than the first and second surface areas, causing the body member to be generally planar, and the first side and the second side tapering toward each other at the bottom of the body member, the front and the rear of the body member tapering toward each other at the bottom of the body member, a first wire groove formed at the top end of the body member in the front of the body member and extending from the first side to the second side, the first wire groove for receiving and holding a first portion of a first wire coil of the helical heater wire, the first wire groove having a curved shape corresponding to a curved shape of the first portion of the first wire coil, the first side and the second side tapering toward each other at the top of the body member, the front and the rear of the body member tapering toward each other at the top of the body member, a second wire groove formed at the top end of the body member in the rear of the body member spaced apart from and opposite the first wire groove, the second wire groove extending from the first side to the second side, the second wire groove for receiving and holding a portion of a second wire coil of the helical heater wire adjacent to and spaced apart from the first wire coil, a third wire groove formed at the bottom end of the body member in the front of the body member and extending from the first side to the second side, the third wire groove for receiving and holding a portion of a third wire coil of the helical heater wire, and a fourth wire groove formed at the bottom end of the body member in the rear of the body member and spaced apart from and opposite the third wire groove, the fourth wire groove extending from the first side to the second side, the fourth groove for receiving and holding a portion of a fourth wire coil adjacent to and spaced apart from the third wire coil, said first wire groove substantially parallel to said second wire groove and said third wire groove substantially parallel to said fourth wire groove.

11. The insulator of claim 10 wherein each of said first, second, third and fourth wire grooves has a shape corresponding to a shape of a portion of said first, second, third and fourth wire coil, respectively.

12. The insulator of claim 10 further comprising at least one additional groove in the body member for receiving and holding a portion of a coil of a second helical heater wire having a diameter different from said helical heater wire disposed adjacent said helical heater wire.

13. The insulator claim 12 wherein the at least one additional groove is a pair of spaced-apart grooves, one groove from said pair on the front and another groove from said pair on the rear of the body member.

14. The insulator of claim 10 wherein the first wire groove is for holding no more than about 20% of the circumference of the first wire coil.

15. The insulator of claim 10 wherein the first wire groove is for holding at least 10% of the circumference of the first wire coil.

16. The insulator of claim 10 further comprising an opening through the body member for receiving a support member.

17. The insulator of claim 10 wherein the maximum width from the front to the rear across either of said first or second sides is dimensioned for being no more than 110% of the separation of coils of said multiple wire coils.

* * * * *